US008947026B2

(12) United States Patent
Graner et al.

(10) Patent No.: US 8,947,026 B2
(45) Date of Patent: Feb. 3, 2015

(54) SELF-PROPELLED WORKING MACHINE WITH ELECTRICAL DRIVE SYSTEM AND PROCESSES FOR OPERATING THE SAME

(75) Inventors: Klaus Graner, Ahlen-Uttenweiler (DE); Oliver Fenker, Warthausen (DE); Johann Lis, Riedlingen (DE)

(73) Assignee: Liebherr-Components Biberach GmbH, Biberach/Riss (DE)

( * ) Notice: Subject to any disclaimer, the term of this patent is extended or adjusted under 35 U.S.C. 154(b) by 967 days.

(21) Appl. No.: 13/084,962

(22) Filed: Apr. 12, 2011

(65) Prior Publication Data

US 2011/0248654 A1 Oct. 13, 2011

(30) Foreign Application Priority Data

Apr. 12, 2010 (DE) ..... 10 2010 014 644

(51) Int. Cl.

| | |
|---|---|
| ***H02P 7/00*** | (2006.01) |
| ***E01C 23/088*** | (2006.01) |
| ***E01H 5/09*** | (2006.01) |
| ***E02F 3/20*** | (2006.01) |
| ***E02F 9/20*** | (2006.01) |
| ***E21C 41/26*** | (2006.01) |

(52) U.S. Cl.

CPC ..... *E01C 23/088* (2013.01); *E01H 5/098* (2013.01); *E02F 3/20* (2013.01); *E02F 9/2025* (2013.01); *E02F 9/2075* (2013.01); *E21C 41/26* (2013.01)

USPC ..... 318/152; 318/102; 318/778; 318/430

(58) Field of Classification Search

USPC ..... 318/152, 102, 109, 110, 112, 773, 778, 318/779, 786, 430; 363/34, 37, 131

See application file for complete search history.

(56) References Cited

U.S. PATENT DOCUMENTS

| | | | | |
|---|---|---|---|---|
| 3,867,992 | A * | 2/1975 | Waterman | 180/14.4 |
| 4,506,464 | A * | 3/1985 | Cartner | 37/91 |
| 4,966,242 | A * | 10/1990 | Baillargeon | 180/9.44 |
| 5,259,692 | A * | 11/1993 | Beller et al. | 404/90 |
| 5,714,851 | A * | 2/1998 | Antony et al. | 318/148 |
| 6,394,696 | B1 * | 5/2002 | Culver | 404/75 |
| 7,330,012 | B2 * | 2/2008 | Ahmad et al. | 318/811 |
| 7,511,446 | B2 * | 3/2009 | Bixel | 318/778 |

(Continued)

FOREIGN PATENT DOCUMENTS

| | | |
|---|---|---|
| DE | 19941800 | 5/2000 |
| DE | 202007002403 | 4/2007 |
| DE | 102007007996 | 8/2008 |

*Primary Examiner* — Bentsu Ro
*Assistant Examiner* — Thai Dinh
(74) *Attorney, Agent, or Firm* — Dilworth & Barrese, LLP.

(57) ABSTRACT

The present invention relates to a self-propelled working machine, especially in the form of a surface milling machine, such as asphalt-milling machine or snow-milling machine comprising a main operating unit and/or a drive unit, which is operable in a steady-state or near steady-state operating status and is drivable by a drive device comprising at least an electrical motor, the electrical motor being associated with a start-up including a frequency converter for the limitation of starting current. The invention also relates to a process for operating such a self-propelled working machine. According to the invention an operating circuit for steady-state operation is provided, comprising a jumper for bridging the frequency converter following starting or reaching steady-state operational status. Optionally, the jumper is switchable to activate or inactivate the frequency converter of the start-up circuit, respectively.

19 Claims, 7 Drawing Sheets

(56) References Cited

U.S. PATENT DOCUMENTS 8,014,110 B2 * 9/2011 Schnetzka et al. ..... 361/31
8,242,719 B2 * 8/2012 Kubal et al. ..... 318/105
2005/0206250 A1 * 9/2005 Steffen et al. ..... 310/59
2006/0249320 A1 * 11/2006 Carter et al. ..... 180/65.5
2008/0051949 A1 * 2/2008 Seo et al. ..... 701/22

* cited by examiner

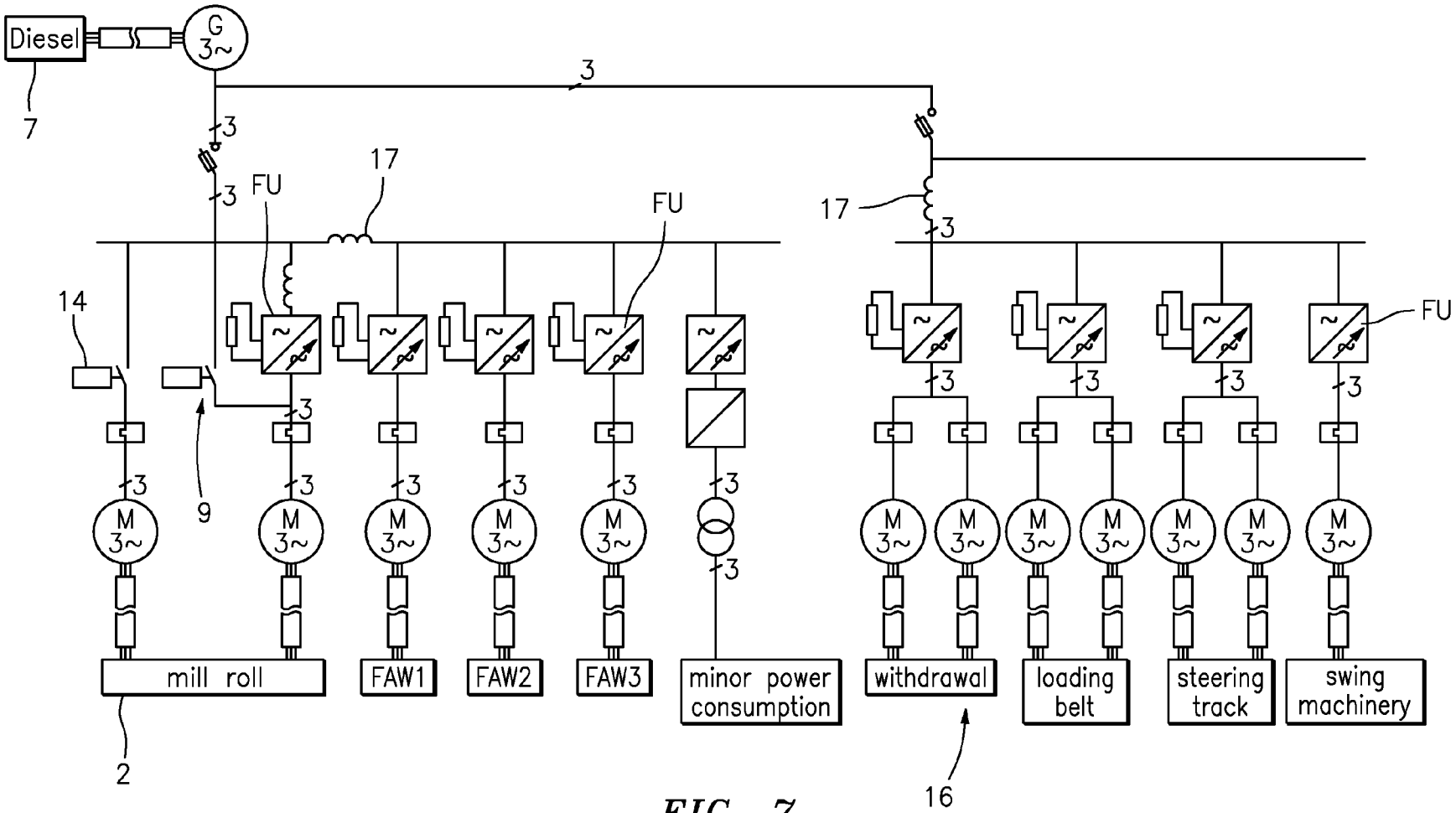
Diesel
7
G
3
3
3
FU
17
FU
3
3
3

SELF-PROPELLED WORKING MACHINE WITH ELECTRICAL DRIVE SYSTEM AND PROCESSES FOR OPERATING THE SAME

BACKGROUND OF THE INVENTION

The present invention relates to a self-propelled working machine, especially in the form of a surface milling machine, such as for example a Surface Miner, asphalt-milling machine or snow-milling machine, with a main working and/or power unit which can be operated in a steady-state or nearly steady-state operating status and which can be driven by a drive device comprising at least one electrical motor, the electrical motor being equipped with a start-up circuit including a frequency converter to limit starting current. The invention also relates to a process for operating such a self-propelled working machine.

Surface Miners are for example continuously operating surface mining machines using a rotating roll for grinding rocks or soil in a milling action and which usually continuously advance by means of caterpillars in order to force the roll into the rock. In this approach said roll constitutes the main operating unit which requires high energy input and thus also requiring a suitable drive system. In this regard, DE 10 2007 007 996 B4 discloses a diesel electrical drive system wherein the mill roll of the Surface Miner is driven by an electrical motor supplied with electrical power by a generator, which in turn is driven by a diesel engine. Further embodiments of Surface Miners are disclosed in the references WO 03/058031 A1, DE 10 2008 008 260 A1, DE 10 2007 044 090 A1, DE 10 2007 028 812 B4, DE 199 41 800 C2, DE 199 41 799 C2 or DE 20 2007 002 403 U1.

Such electrical drives have considerable advantages over hydrostatic drive systems, such as especially higher efficiency and greater ease of maintenance. Due to substantially better efficiency resulting in lower operational costs, wherein the latter being quite remarkable in regard of required engine performance, higher costs of purchase for electrical motors may be compensated in a reasonably short period of time. The concept of a comparable diesel electrical drive hence lends itself not only for the use in Surface Miners but also in similar self-propelled working machines, such as asphalt milling machines, snow milling machines, or also in agricultural machines such as combined harvesters or the like which during processing work continuously and near steady-state, i.e. performing an especially rotative main working motion at constant or nearly constant rpm, respectively, and wherein the driving motion represents the feed motion. In this context, "steady-state" operational status does not necessarily mean "exactly constant" in the sense that said main operating unit is actually operated at exactly constant rpm but also includes minor variations near the operational set point, for example due to variations of rpm of the diesel engine.

However, start-up procedure of such diesel electrical drive systems for said type of processing machines poses problems. Direct starting the drive motor connected to the generator is not useful since in this case a very high start-up current will occur which can be five or six times that of the nominal current and for which the entire system would have to be suitably dimensioned or overdimensioned respectively.

Therefore the use of gentle start-up circuits wherein start-up current is limited by lowering voltage is well known. However, this is only possible if no or almost no torque is required during start-up. If only a starting torque is required that is smaller than one third of the motor's starting torque in case of direct starting, the working motor may also be started by means of a star-delta-connection. However, even in this approach high start-up current still occurs which is generally significantly higher than nominal current and must be taken into account when dimensioning the generator, resulting in that the latter becoming bigger and more expensive.

However, in the case of Surface Miners a rather high starting torque might be required, for example for jerkily loosening a mill roll after it became frozen. In cases wherein an essential part of the nominal torque or even a higher starting torque which might be twice as high as the nominal torque is required due to an external load torque or required start-up times installation of a frequency converter is known converting the frequency supplied by the generator in order to limit incoming current during start-up. As shown in FIG. 10, the respective frequency converter FU is inserted between the generator G and the electrical motor M of the drive system.

Although the (main) work drive system while in use is operated at constant or almost constant rpm, respectively, feeding then will take place via said frequency converter during the entire period of operation, thus requiring the frequency converter to be at least dimensioned according to the nominal power of the work drive system. This is disadvantageous with respect to losses, efficiency, operational costs and wear.

SUMMARY OF THE INVENTION

The object of the present invention thus is to create an improved self-propelled working machine as well as an improved process for operating the same, avoiding the disadvantages of the state of the art, and to further develop the latter suitably. Especially, an improved efficiency and lower operational costs shall be achieved by simple means without sacrificing a trouble-free, safe start-up.

The object of the present invention will be solved by a self-propelled working machine and process according to the description herein. Preferred embodiments of the invention are the subject of the description herein.

It is thus recommended to use a frequency converter for the start-up of the drive system to limit the start-up current, then, however, to work without the frequency converter during steady-state operation to avoid losses occurring in the frequency converter and reduced efficiency of electrical motors that occurs if they are operated with the frequency converter. After start-up of the work unit or after having almost reached the desired steady-state operating status the frequency converter used for start-up is bypassed. According to the invention an operating circuit is provided for steady-state operation comprising a jumper for bridging the frequency converter after start-up and/or reaching the steady-state operating status. The jumper may optionally be actuated to activate or deactivate the frequency converter of the start-up circuit respectively. Using a frequency converter during start-up phase and bridging it during steady-state operation has the following advantages:

- Constant or unnecessary losses in the frequency converter no longer occur during continuous operation but are only acceptable during start-up. Especially with high performance machines this allows considerable savings in operational costs.
- Motor efficiency during steady-state can be improved because motor efficiency is higher when directly fed by a generator or another electrical power supply having neat sinus voltage than in case of feeding through a frequency converter.
- Availability will be improved and maintenance intervals may be extended as possible problems or failures of permanent operation of a frequency converter will be avoided, what especially might have strong effects in the case of extensively used machines having long term operational cycles.

The insulation of the motor will not be exposed to permanent stress caused by high voltage peaks and high voltage variations $\Delta U/\Delta t$ during feeding via frequency converter.

In an embodiment of the invention the operating circuit may be designed for an immediate, direct interconnection of the frequency of the electrical power supply to the electrical motor of said drive device, and/or to at least bridge all the frequency converters associated to the main operating unit and/or the high performance work units during steady-state operation. Direct interconnection of frequency of the electrical power supply to the electrical motor results in that the frequency of the electrical power supply defines the rotational speed of the motor. If, advantageously, a generator powered by a combustion engine, especially by a diesel engine, is used as electrical power supply, even with the combustion engine being operated in the desired manner at nearly constant rpm, the desired drive speed of the drive unit or rpm of the electrical motor, respectively, may be achieved by selecting the number of pole pairs of the generator and of the work motor as well as possible gear transmissions between electrical motor and work unit, as well as combustion engine and generator, such that the desired range of rpm of the work unit will be in the feasible rpm range of the combustion engine, thus suitably achieving at least nearly constant rotational speed of the tool or the rotational speed of the work unit at least nearly constant rotational speed of the combustion engine. If, instead of a diesel engine having a generator, any other power supply with nearly constant frequency of the electrical voltage is used rpm of the main work motion may be set similarly by varying the number of pole pairs of the electrical motor and/or the gear transmissions.

Bridging of the frequency converter after start up of the work unit may basically be controlled in different ways. For example, time dependent bridging would be possible, such that after a predetermined span of time has elapsed from start-up, the bridging device is activated. However, in an advantageous embodiment of the invention a bridging device for the frequency generator depending of the rotational speed is provided. Said operating circuit may comprise a control device which activates the jumper depending on rpm of the main operating unit and/or the main drive unit and/or the electrical motor. Especially, said control device can deactivate the jumper below a predetermined nominal rotational speed such that the electrical motor is driven via the frequency converter, and will be activated above a predetermined nominal rotational speed such that the frequency converter will be bridged. Said disconnecting rotational speed, above of which the frequency converter will be bridged, may be the nominal rotational speed during steady-state operation or optionally may be a rpm that will be lowered by a predetermined amount, for example 95% of said nominal rotational speed during steady-state operation.

In an embodiment of the invention the electrical power supply provides a working frequency for at least one electrical motor in a range significantly above the frequencies of known industrial power networks. Advantageously, working frequency which is used for the electrical motor for steady-state operation may be higher than 75 Hz, preferably higher than 100 Hz and may especially be in the range approximately 100 to 200 Hz. This allows realization of especially compact, and thus small and consequently low cost drive motors in limited installation spaces.

For different load ranges different operating frequencies and/or operating voltages may be provided. Advantageously, within full load range wherein the main work unit and/or drive unit is under operational load the electrical system may be used at higher operational frequency, preferably in the range from 100 Hz to 200 Hz, and/or at a higher operational voltage, while in partial-load range of operation, wherein for example the main work unit will not be operated and/or only the displacement drives are being actuated, a lower operational frequency, for example in the range of 50 to 100 Hz, and/or a lower operational voltage may be used. Alternatively or additionally, during idle operation wherein for example only ancillary units such as cooling or air conditioning systems are operated, an even further reduced operational frequency and/or operational voltage may be used.

The electrical motor whose frequency converter is bridged for steady-state operation may be one or multiple drive motors of the main operating unit effecting the main working motion of the self-propelled working machine and/or defining the function thereof. In the case of a surface milling machine it may especially be the drive motor or motors for the mill roll, wherein, depending on the system design and marginal conditions, the use of only one electrical motor or alternatively also the use of multiple electrical motors may be implemented, wherein advantageously, if multiple electrical motors are used for driving the work unit, said electrical motors are coupled to each other mechanically and/or by means of control devices such that they essentially run at equal rpm or at proportional rpms.

The current carrying capacity of the frequency converter or converters for the start-up process will advantageously be selected such that start-up will be possible at a torque up to nominal torque or even higher, wherein, if applicable, it may be of advantage that up to twice the nominal torque for the start-up process will be available. Due to the operational principle of a frequency converter the generator will not be loaded with high reactive currents during start-up procedure, and actually the generator is only for providing a current proportional to the actual motor output and may therefore be designed with significantly smaller dimensions.

In the case that start-up procedure will not always be performed load free, but still significantly below nominal torque; if only one electrical motor is used a frequency converter may be employed having a current carrying capacity which is smaller than the motor current at nominal torque.

If, however, multiple electrical motors are used to drive the main operating unit it may be expected that not all but only part or even only one of the electrical motors will be associated to a frequency converter, and consequently for start-up procedure only this part or only said one of the electrical motors is used. Advantageously, in this case during start-up only the electrical motor or the electrical motors having an associated frequency converter is/are supplied with energy so that only this electrical motor or these electrical motors will bring about main working motion up to nominal rpm. During this time the electrical motor or the electrical motors lacking a frequency converter are disconnected from the electrical power supply and, while in an electroless state, are accelerated by mechanical coupling to the main operating unit or the respective electrical motor. After reaching the steady-state operating status the at least one frequency converter for the at least one electrical motor is bridged and the at least one additional electrical motor lacking a frequency converter is connected to the electrical power supply so that consequently all electrical motors of said main operating unit will directly be supplied by the electrical power supply.

Especially, in this context the current carrying capacity of the frequency converter or the total of all the current carrying capacities of the multiple frequency converters may be dimensioned smaller than the total of the motor currents at nominal torque if the load torques during start-up is smaller than the nominal torque.

In an embodiment of the invention the frequency converter may be equipped with or may connected to a braking resistor respectively. This allows savings of mechanical brakes which may possibly be mounted on the drive motors of the main operating unit by electrically braking the main operating unit to standstill by means of said braking resistor. Advantageously, a braking circuit comprising a cut-off device to separate all direct connections of the at least one electrical motor to the electrical power supply, as well as means of synchronization for synchronizing the frequency converter or converters to the electrical motor before initiation of braking will be provided. Advantageously, before electric braking all direct connections of the at least one electrical motor to the electrical power supply are disconnected, for example by means of contactors, where advantageously the at least one frequency converter is synchronized to the respective electrical motor before initiating the electrical braking process.

Depending on the dimensions of the frequency converter and the braking resistor a brake torque up to nominal torque of the electrical motor or even beyond that may be achieved.

In an embodiment of the invention the frequency converter may also be used to operate the main operating unit at reduced rpm, for example to provide a creep speed for maintenance purposes and/or for positioning the work unit in order to perform tool exchange. For this purpose a creep speed circuit and/or a positioning circuit may be expected which deactivates bridging of the at least one frequency converter and desirably controls the at least one frequency converter to achieve reduced rpm and/or to approach a predetermined position.

Alternatively or additionally a reverse circuit may be expected which also deactivates bridging of the at least one frequency converter and reverses work motion of said main operating unit and/or brings about backward motion of the main operating unit by means of said at least one frequency converter. Such a reversal may for example be used for loosening and clearing blockades. Loosening a standstill or reversal are possible up to nominal torque of the drive system or even beyond it, depending on the dimensions of the at least one frequency converter.

In an embodiment of the invention the electrical system of the self-propelled working machine is not only used to drive its main operating unit and/or a drive unit but also for the supply of at least one additional electrical ancillary unit, such as various electrical utility loads, and in the case of a surface milling machine especially the drives and/or for example the drives of a discharge conveyor, loading conveyor, a steering device and/or a pivoting mechanism. Such ancillary units usually have significantly lower power consumption than the drive of the main operating unit. Nevertheless, the drive of the main operating unit and the ancillary electrical units may basically be supplied using a common voltage level.

However, in order to work with lower currents for the main drive supplying this main drive with a higher voltage it would be advantageous. However, this higher voltage is undesirable for the ancillary units due higher expenditures for insulation and higher costs for the frequency converters on these ancillary units, with the respective currents being low nevertheless. Advantageously, frequency converters are employed in the ancillary units in order to allow altering their working speed in comparison with the working speed of the main operating unit, in order to be able to adapt operation of the machine to various work and environment parameters. On the one hand, in order to be able to supply the main drive with higher voltage, and on the other hand to avoid this higher voltage for the ancillary units, in an embodiment of the invention, two voltage levels may be provided in the working machine, i.e. a higher voltage level for supplying electrical utility loads, especially electrical motors, with a high wattage, and a lower voltage level to supply the electrical utility loads, especially electrical motors, with lower wattage.

In an embodiment of the invention different voltage levels may be produced by a common generator which for this purpose may be designed having two separate stator windings each of which providing one voltage level. In such an assembly the two voltage levels are galvanically isolated from each other. If, however, such a galvanic isolation is not required the generator may also be designed with only one stator winding, and hence with the lower voltage level being extracted from a tapping of this single winding.

A transformer or a DC/DC converter may also be employed for reducing the voltage for the ancillary units.

In addition to said drives for discharge conveyors, loading conveyors and the like said ancillary units may especially also comprise at least one cooling unit which advantageously may be operated at various operating frequencies and/or various operating voltages and/or to which a frequency converter is associated to meet various cooling requirements. Advantageously, said at least one cooling unit may also be operated in the case if all ancillary units are disconnected, for example to ensure adequate cooling of the drive and supply units in high temperature environments, even in the case if the surface milling machine itself is not in operation. Operability at various operating frequencies and/or operating voltages allows increase of cooling performance depending on the load range the machine is operated in.

BRIEF DESCRIPTION OF THE DRAWINGS

The invention is exemplified in more detail below, using examples of preferred embodiments and the respective drawings, wherein:

FIG. 7: is a schematic representation of the complete drive system of the self-propelled working machine of FIG. 1 with main and ancillary units wherein each is driven by electrical motors, with the main and ancillary units being supplied by the same voltage level, FIG. 10: is a schematic representation of a diesel electrical drive device for the main operating unit of a self-propelled working machine lacking a bridging device for the frequency converter the electrical motor is associated with.

DESCRIPTION OF THE PREFERRED EMBODIMENTS

Figure 1:
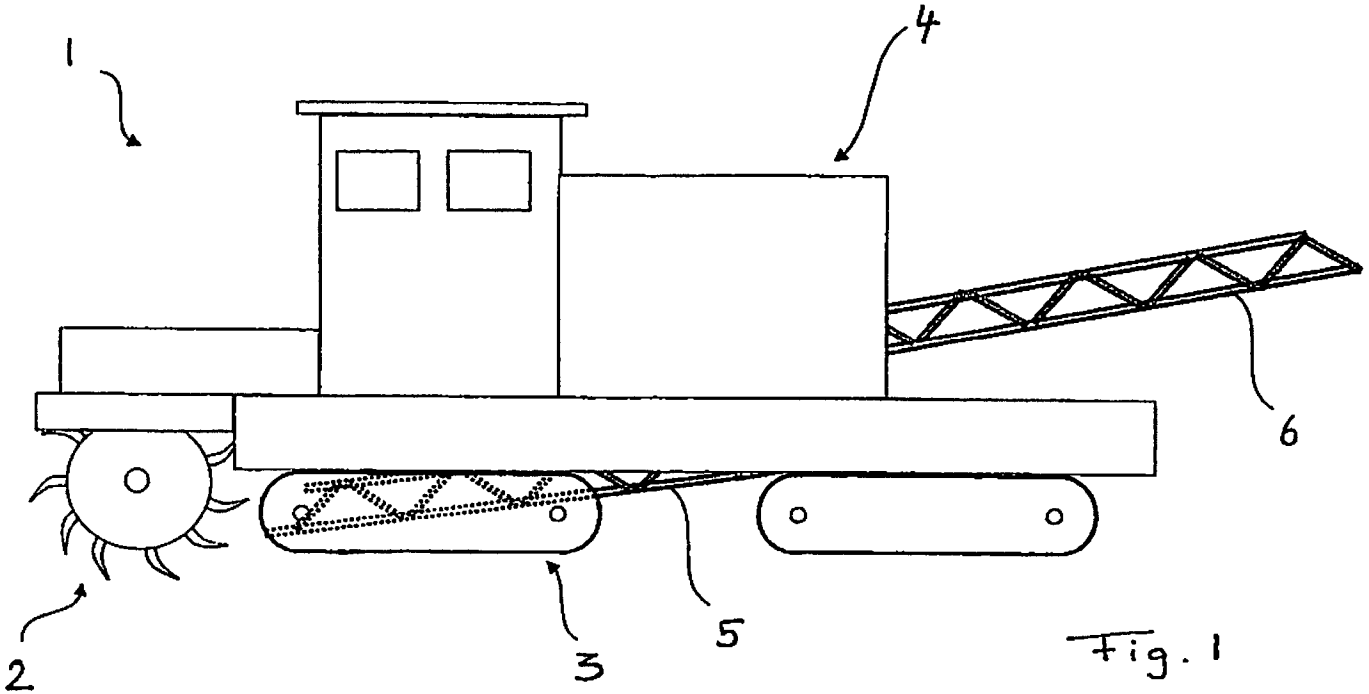
FIG. 1: is a schematic representation of a self-propelled working machine, which in an advantageous embodiment of the invention is designed as a self-propelled surface milling machine in the form of a Surface Miner which however may also represent an asphalt milling machine.

FIG. 1 shows a self-propelled working machine in the form of a surface milling machine 1, the main working unit 2 of which is a mill roll which is rotationally drivable around a horizontal axle, the outer peripheral surface of which is equipped with cutting tools suitable to grind a soil or asphalt layer or the like. In the process the surface milling machine 1 is continually moved by means of running gears, especially caterpillars 3 to confer continuous feed motion to said mill roll. Machine body 4 provided with mobile support on the soil by said caterpillars 3 and carrying said mill roll furthermore comprises means of conveyance for eliminating milled material. The milled material derived from the mill roll is transferred to an intake conveyor 5 passing the material to a loading conveyor 6 for loading the crushed material for example onto a truck. Said intake and loading conveyors 5 and 6 may for example be designed as conveyor belt systems.

Figure 2:
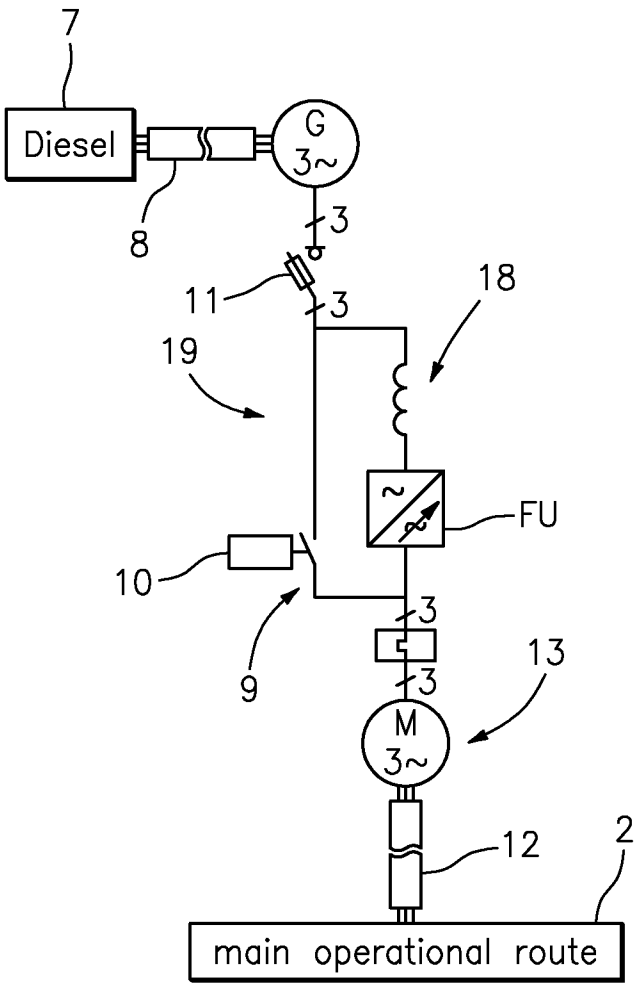
FIG. 2: is a schematic representation of the drive device for the main operating unit of the self-propelled working machine of FIG. 1, which in this embodiment is designed as a diesel electrical unit having an electrical motor which is supplied via a frequency converter associated to a jumper.

According to FIG. 2 said main operating unit 2 may be driven by means of an electrical motor M which in turn may be coupled to the main operating unit by means of clutch and/or gear 12 and may be housed inside the mill roll.

In the embodiment shown in the drawings a generator G is provided as electrical power source which is driven by a combustion engine by means of clutch and/or gear 8, wherein, in the embodiment shown, the combustion engine designed as a diesel engine 7. Alternatively or in addition the self-propelled working machine, according to the embodiment, might also use another electrical power supply and/or might have a power supply connection, for example in the shape of a wire, for connection to an external electrical power supply.

As shown in FIG. 2, the electrical motor may optionally be supplied by the generator G via frequency converter FU or directly, i.e. lacking frequency converter FU or a jumper incorporated in the latter. Jumper 9 represents a bypass of the supply line circumventing frequency converter FU.

Advantageously, said jumper 9 may be actuated by means of switch element 10 to optionally supply motor M via frequency converter FU or to bypass the same.

By means of a disconnecting switch 11 electrical supply of the electrical motor M may be completely separated from the generator G.

For initiation of main operating unit 2 the electronic control device of the self-propelled working machine will release switch element 10 for the deactivation of jumper 9 so that generator voltage of the generator G will supply frequency converter FU. The electrical motor M is initiated through frequency converter FU until electrical motor M and/or main operating unit 2 will reach the desired operational speed of rotation. As soon as the latter is reached jumper 9 is activated by closing the switch element 10 so that the electrical motor M will directly be supplied by the sinus voltage of the generator G. The frequency converter FU is bypassed. In the process, the diesel generator set 7 preferably is operated at constant rpm. In order to achieve the desired operational rotational speed of the operating unit 2 the number of pole pairs of the generator G and the electrical motor M as well as the gear transmissions of gears 8 and 12 are suitably selected to achieve the desired rpm of the main operating unit 2 without changing rpm of the diesel generator set 7.

Depending on the required torque of initiation the current carrying capacity of the frequency converter FU is selected such that the desired starting torque may be reached. The same may be lower or also higher than the nominal torque for steady-state operation, depending on the working machine.

Figure 3:
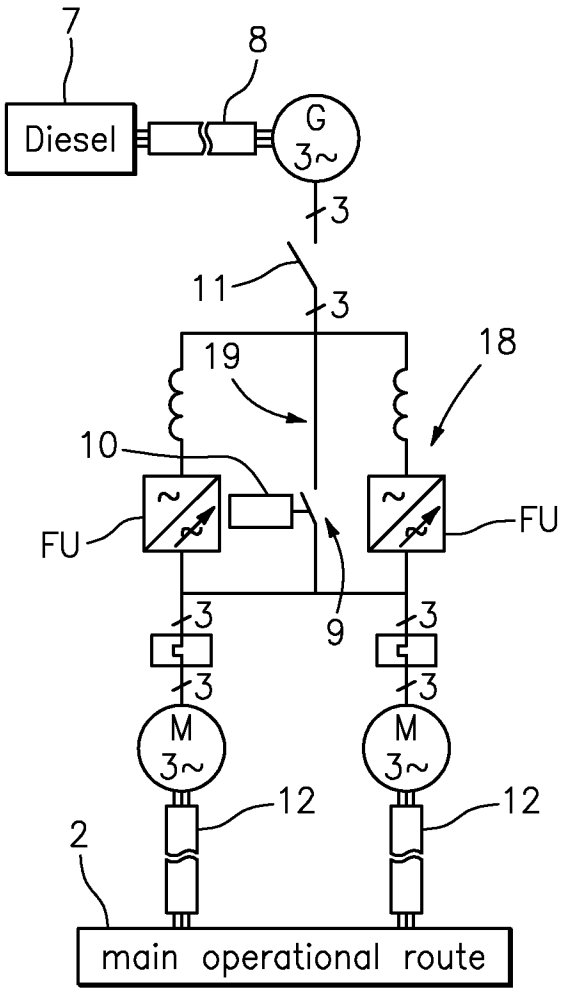
FIG. 3: is a schematic representation of the drive device for the main operating unit of the self-propelled working machine of FIG. 1, wherein according to an alternative embodiment the drive system comprises two electrical motors, each associated to a frequency converter.

According to FIG. 3, multiple electrical motors M may also be advantageously provided for the drive system of the main operating unit 2. In the embodiment shown in the drawings two electrical motors M are provided each of which having a drive connection to the main operating unit 2 and which are mechanically coupled to each other via main operating unit 2. In the embodiment according to FIG. 3 a frequency converter FU through which the voltage produced by the generator G may be supplied to the electrical motors M is associated to each one of the electrical motors M. Both frequency converters FU may be bridged by means of a shared jumper 9 so that in turn the operational voltage of the generator G may be applied directly to the electrical motors M during steady-state operation.

Figure 4:
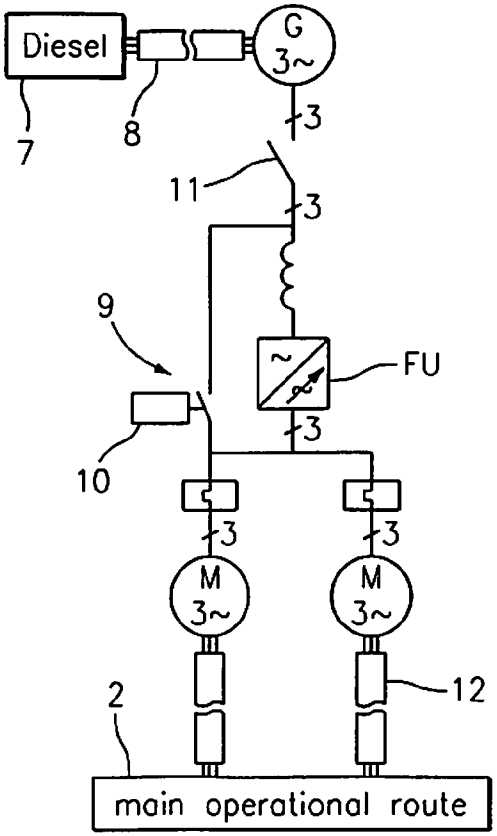
FIG. 4: is a schematic representation of the drive device for the main operating unit of the self-propelled working machine of FIG. 1, wherein according to a further embodiment of the invention the drive system comprises two electrical motors sharing a frequency converter.

As shown in FIG. 4, during start-up, the two electrical motors M may also be supplied through a shared frequency converter FU. Whereas in the embodiment according to FIG. 3 having separate frequency converters the current carrying capacity of which must be adapted to the starting torque which is to generated by each motor during the start-up, in the embodiment according to FIG. 4 the current carrying capacity of the frequency converter FU must be selected consistently with the total of both start-up currents of both electrical motors M at the starting torque which has to be generated by each motor.

Figure 5:
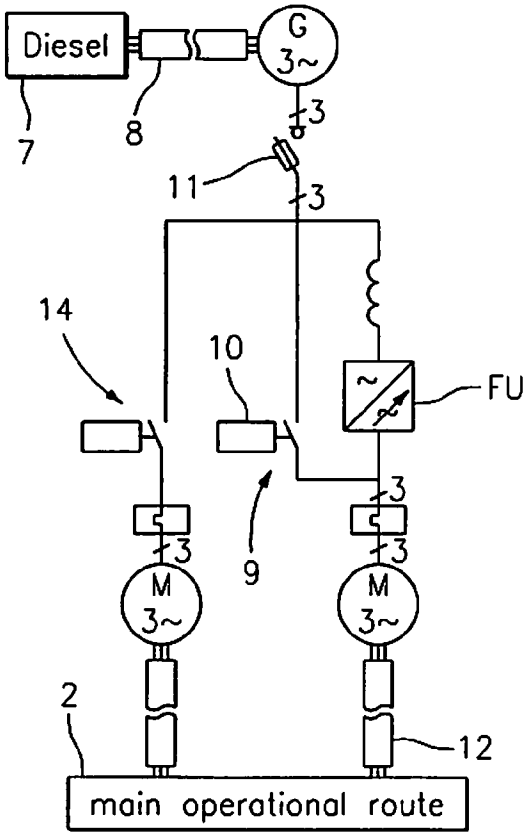
FIG. 5: is a schematic representation of the drive device for the main operating unit of the self-propelled working machine of FIG. 1, wherein according to a further embodiment of the invention the drive system comprises two electrical motors, wherein only one of the motors is associated to a frequency converter.

If the required starting torque is significantly lower than the total of nominal torques of the electrical motors M during steady-state operation a frequency converter FU may be associated to only one of the electrical motors M, as is shown in FIG. 5. In this embodiment, during start-up procedure the second electrical motor M is completely disconnected by means of a disconnecting switch 14 from voltage of the electrical supply, so that this second electrical motor M will be accelerated by the system while the former itself being electroless. Acceleration is solely effected by that electrical motor M which is fed through a frequency converter FU. If, on the one hand, the desired operational rotational speed for steady-state operation of the main operating unit 2 is reached, then jumper 9 is activated by closing of switching element 10 to bridge said frequency converter FU. On the other hand, the disconnecting switch 14 is closed for connection of the second electrical motor M to the voltage supply. Then accordingly both electrical motors 17 are in turn directly connected to the sinus voltage of the generator G during steady-state operation.

Figure 6:
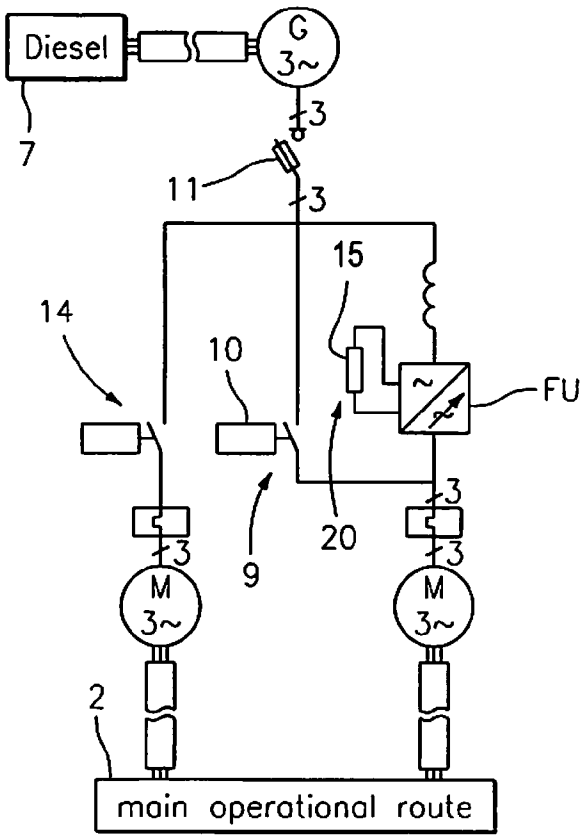
FIG. 6: is a schematic representation of the drive device for the main operating unit of the self-propelled working machine of FIG. 1, differing from the embodiment according to FIG. 5 in that the frequency converter is associated to a braking resistor.

In an advantageous embodiment of the invention a braking resistor 15 may be associated to frequency converter FU to allow for electrically braking of the main operating unit 2 by means of the electrical motor M. As is illustrated in FIG. 6 braking resistor 15 is arranged in a loop connected to said frequency converter FU. Depending on the dimensions of frequency converter FU and braking resistor a brake torque up to nominal torque of the electrical motor M or even above may be achieved. Before electrical braking all direct connections from electrical motors M to generator G will be disconnected. Furthermore, frequency converter FU is synchronized to electrical motor M before electrical braking is initiated.

As shown in FIG. 7, generator G which is driven by diesel engine 7 not only is used for supplying drive device 13 of the main operating units 2 but also for supplying additional ancillary units 16. These ancillary units 16 may, on the one hand, comprise drives FAW1, FAW2 and FAW3 for displacing caterpillars 3 of the surface milling machine 1 shown in FIG. 1. Furthermore, ancillary units 16 may also comprise the drive devices of further operational units, such as discharge conveyor belt, loading conveyor belt, steering track, or pivoting mechanism. In the embodiment shown in the drawings said displacement drives FAW1, FAW2 and FAW3 each comprise only one electrical motor M whereas drive devices for additional ancillary units, such as discharge conveyor belt, loading conveyor belt and steering track each comprise two electrical motors M. However, depending on the power required and the ancillary unit, other configurations may also be provided.

Advantageously ancillary units 16 are each equipped with a frequency converter FU in order to allow variable control of the respective electrical motors M with respect to their rpm, allowing adaptation of working operation to variation of parameters, such as ground hardness, slope and the like, in spite of the mill roll being in a stationary operational status.

In this connection, in the embodiment according to FIG. 7 the ancillary units 16 including said displacement drives on the one hand, as well as drive device 13 of the main operating unit 12 on the other hand are fed by a shared voltage level, in this case the ancillary units 16 being connected by means of mains chokes 17.

For supplying drive device 13 of the main operating unit 2 with a higher voltage and consequently lower currents, on the one hand, and on the other hand, not having to provide stronger insulation and unnecessarily expensive special frequency converters FU for ancillary units 16 according to one advantageous embodiment of the invention feeding of main drive system on the one hand and ancillary units on the other hand by different voltage levels will be expected. A higher voltage level is provided to supply the motors with higher energy throughput, and a lower voltage level will supply the motors with lower energy throughput. Such an embodiment is shown in FIG. 8, wherein both voltage levels are generated by the shared generator G which may be provided with two separate stator windings each providing one voltage level.

Figure 8:
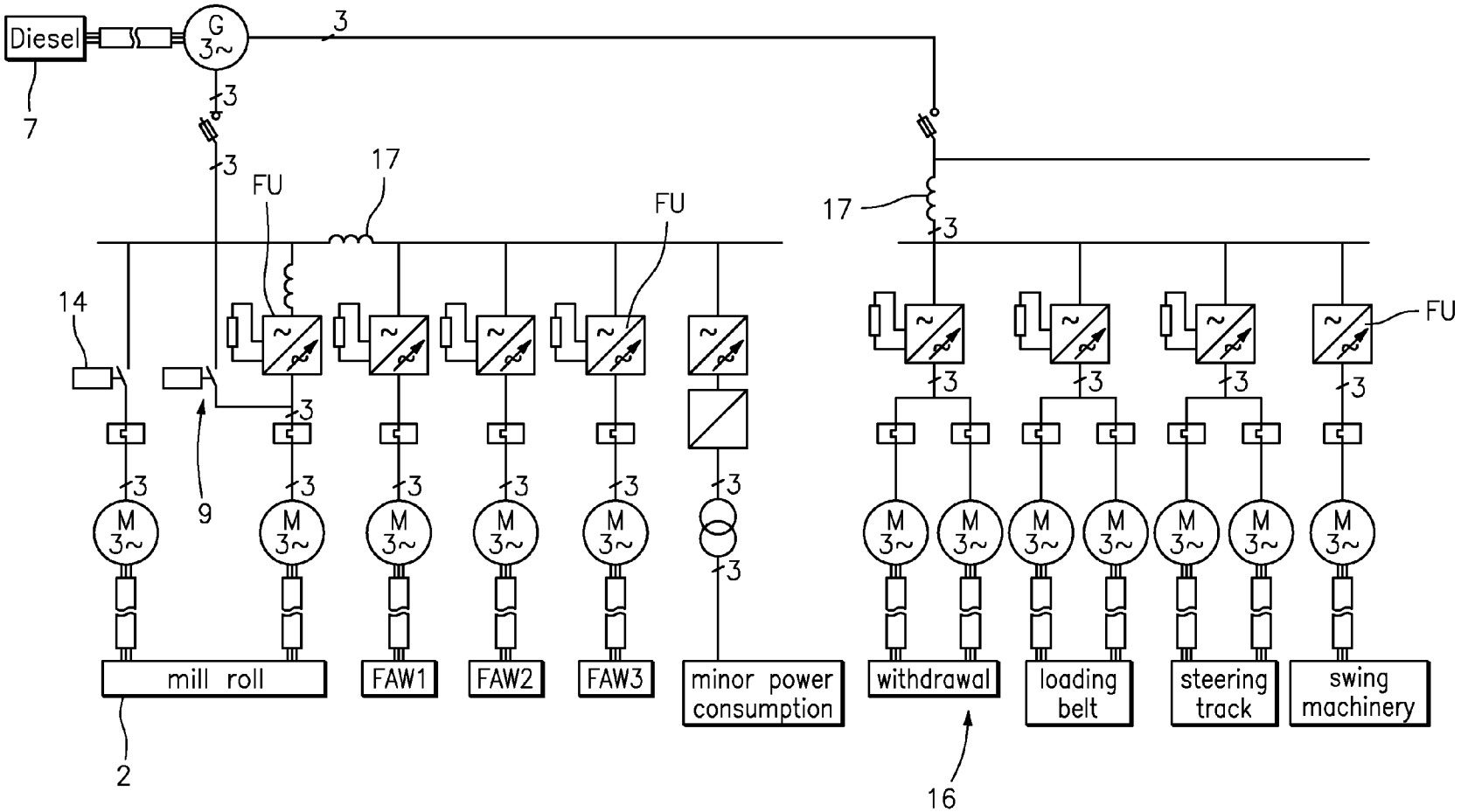
FIG. 8: is a schematic representation of the complete drive system of the self-propelled working machine of FIG. 1 having main and ancillary units wherein each is driven by electrical motors, with the main and ancillary units being supplied by different voltage levels which by means of separate windings are produced by the generator.
Figure 9:
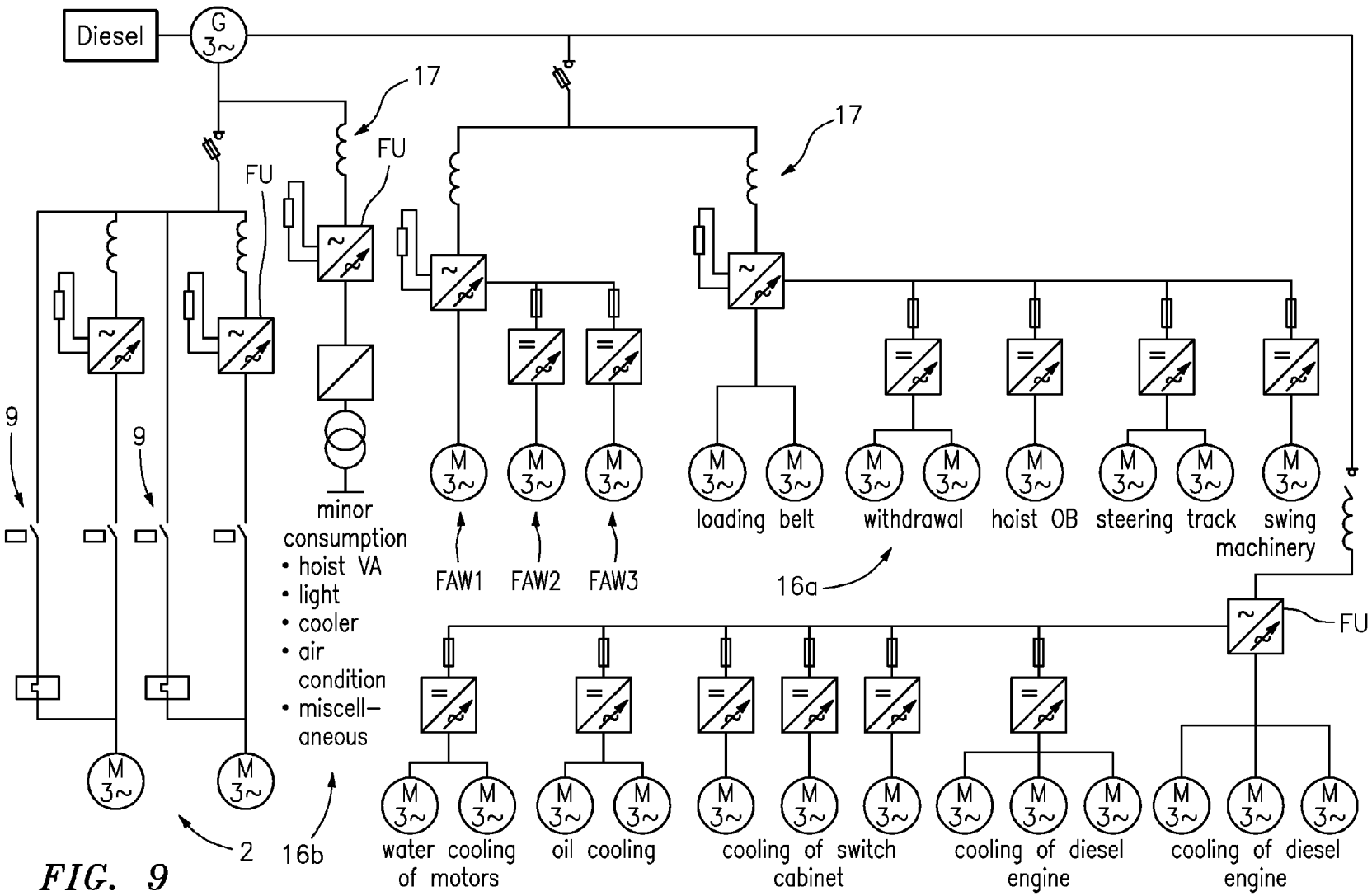
FIG. 9: is a schematic representation of the complete drive system of the self-propelled working machine of FIG. 1 having main and ancillary units wherein each is driven by electrical motors, with the main and ancillary units here again being supplied by different voltage levels and to which different cooling units may be attached and detached independently from other ancillary units, and on which, furthermore, additional ancillary units may be supplied by the voltage level of the main operating unit.
Figure 10:
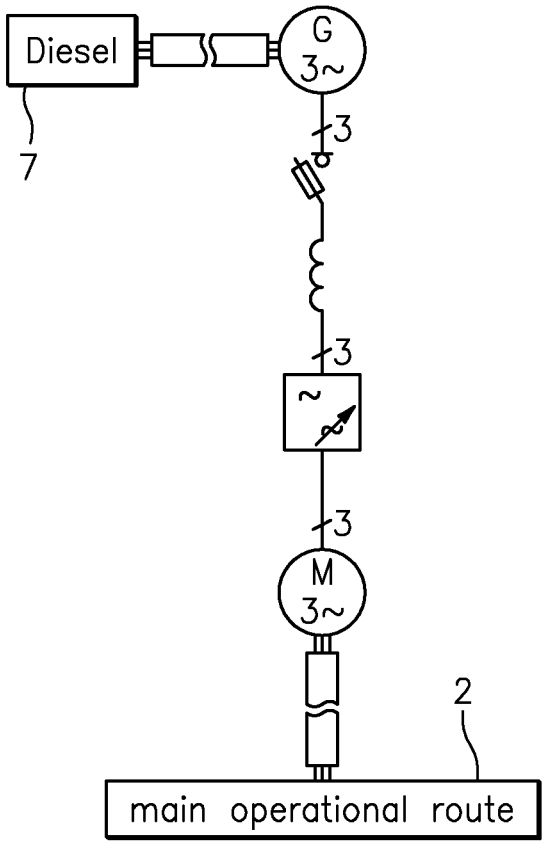

As shown in FIG. 9, displacement drives FAW1, FAW2 and FAW3, which in the embodiments according to FIGS. 7 and 8 may be combined with drive device 13 of the main operating unit 12 or may be co-operated on a shared voltage level, respectively, may also be fed by a lower voltage level which also supplies the other ancillary units 16. In this context, a shared frequency converter FU may be associated to said displacement drives FAW1, FAW2 and FAW3, while it is also possible to have one frequency converter associated to each one of the displacement drives FAW1, FAW2 and FAW3. The displacement drives FAW1, FAW2 and FAW3 may also be fed by a lower voltage level than drive device 13 of the main operating unit 12, wherein said voltage levels may in turn be provided by separate stator windings of the generator G.

As shown in FIG. 9, other power consuming ancillary units 16*b*, such as for example a lifting unit for the mill roll, illumination equipment, a cooling device or an air conditioning unit, may also be fed by the voltage level of the generator G which also supplies the drive device of the main operating unit. Advantageously, voltage in this context may suitably be adapted by means of a transformer. In order to assure availability of said ancillary units even if the main drive is disconnected, the supply of said ancillary units 16*b* may be connected to the generator, bypassing the disconnecting switch for the main drive system, cf. FIG. 9.

As shown in FIG. 9, ancillary units 16 furthermore may also comprise various cooling units which each may comprise one or multiple electrical motors for operation of the cooling unit. Such cooling units may for example comprise one or multiple diesel engine water coolers, a switch cabinet cooling system, an oil cooler, as well as a water cooler for electrical motors. Similar to additional ancillary units 16 said cooling units are advantageously supplied by the lower voltage level which accordingly may be provided by generator G, wherein said electrical motors of the cooling units may advantageously be associated to a frequency converter FU, wherein multiple or all cooling units may be associated to a shared frequency converter or one or all of the cooling units each may be associated to their own frequency converter. Advantageously, said cooling units may be operated at different operational voltages and/or different operational frequencies, depending on the operational load of the working machine, to allow adaptation of cooling performance to the operational load range of the working machine. Advantageously, said cooling units may separately be connected to the electrical power supply or by bypassing the disconnecting switch for the displacement drives and the other ancillary units in order to be able to provide cooling even when the displacement drives are disconnected, respectively, cp. FIG. 9.

The invention claimed is:

1. A self-propelled working machine, comprising:

a main operating unit and/or a drive unit (2), operable in a steady-state operating status and drivable by a drive device (13) comprising at least an electrical motor (M), the electrical motor being associated to a start-up circuit (18) including at least a frequency converter (FU) for the limitation of starting current, and an operating circuit (19) for the steady-state operating status comprising a jumper (9) for bridging the frequency converter (FU) following starting or reaching steady-state operational status, wherein the at least one frequency converter (FU) is associated with a braking resistor (15) and a braking circuit (20) and separation devices (11, 14, 9) for the separation of all direct connections between the at least one electrical motor (M) and an electrical power supply, as well as preferably synchronization means for the synchronization of frequency converter (FU) or of frequency converters (FUs) onto the respective electrical motor (M) before start of braking action are provided.

2. The self-propelled working machine according to claim 1, wherein the operating circuit (19) has a control device for activating/deactivating of jumper (9) according to the working speed of said main operating unit and/or a drive unit (2) and/or said electrical motor (M), jumper (9) preferably being deactivated below a predetermined working speed and is activated above any or above said predetermined working speed.

3. The self-propelled working machine according to claim 1, wherein the operating circuit (19) provides immediate and direct interconnection of frequency and voltage of an electrical power supply to the electrical motor (M) of the drive device (13).

4. The self-propelled working machine according to claim 1, wherein a selectable number of pole pairs of the electrical motor (M) and/or a gear transmission with selectable ratio of transmission/reduction for the setting of the working speed of said main operating unit (2) at a given frequency of the voltage of an electrical power supply is provided.

5. The self-propelled working machine according to claim 1, further including a generator (G) and a combustion engine (7), wherein a selectable number of pole pairs of the generator (G) and/or a selectable number of pole pairs of the electrical motor (M) and/or a gear transmission having selectable ratio of transmission/reduction between the combustion engine (7) and the generator (G) and/or between electrical motor (M) and main operating unit (2) for the setting of the working speed of said main operating unit in a given range of rpm of the combustion engine (7) is provided.

6. The self-propelled working machine according to claim 1, wherein a frequency of the electrical power supply of the electrical system is above 75 Hz.

7. The self-propelled working machine according to claim 1, further including an electrical system and a control device, wherein the electrical system is operable in various load ranges with various frequencies, and the control device advantageously provides higher frequency for full load operation, preferably in a range of 100 to 200 Hz, and provides low frequencies, preferably in the range of 50 Hz to 100 Hz, for part-load operation and/or low-load operation.

8. The self-propelled working machine according to claim 1, wherein the drive device (13) of said main operating unit and/or drive unit (2) comprises multiple electrical motors (M) mechanically coupled to each other through the main operating unit, each of the electrical motors (M) being associated individually or collectively with at least a frequency converter (FU), and the one or multiple jumpers (9) for bridging of all frequency converters (FU) for the steady-state operation is/are provided.

9. The self-propelled working machine according to claim 8, wherein the frequency converter (FU) collectively has a current carrying capacity, which is greater or equal to the nominal current and/or to the total of nominal currents of the at least one electrical motors (M) associated to the at least one FU or to the FUs.

10. The self-propelled working machine according to claim 1, wherein the drive device (13) of said operating unit and/or drive units (2) comprises multiple electrical motors (M), whereof at least one electrical motor (M) is provided without an associated frequency converter and may be decoupled from the electrical power supply during start-up procedure by a separation switch (14), in order to be electroless entrained upwards through mechanical coupling via main operating unit (2).

11. The self-propelled working machine according to claim 10, wherein the frequency converter (FU) in total has a current carrying capacity which is smaller than the motor current of the motor associated to the frequency converter (FU) or frequency converters (FUs) or is smaller than the total of motor currents of the electrical motors associated to the frequency converter (FU) or frequency converters (FUs) at nominal torque.

12. The self-propelled working machine according to claim 1, further including a generator (G) and a combustion engine, wherein the generator (G) is provided as an electrical power supply, the former being drivable, directly or indirectly, by the combustion engine, especially a diesel engine (7).

13. The self-propelled working machine according to claim 1, wherein in addition to the main operating unit (2) at least one electrical ancillary unit (16) is provided and the main operating unit (2) and the at least one ancillary unit (16) are fed by a shared electrical power supply, especially a shared generator (G).

14. The self-propelled working machine according to claim 13, wherein at least two ancillary units (16*a*; 16*b*) are fed from differently high voltage levels.

15. The self-propelled working machine according to claim 1, wherein in addition to the main operating unit (2) at least one electrical ancillary unit (16) is provided which is fed by a lower voltage than the main unit (2).

16. The self-propelled working machine according to claim 1, further including at least one ancillary unit and a shared generator (G), wherein the at least one ancillary unit (16) and the main operating unit (2) are fed from differently high voltage levels provided by the shared generator (G) which preferably has separated stator windings.

17. The self-propelled working machine according to claim 1, wherein at least a ancillary unit (16) is even fed during steady-state operation of the main operating unit (2) from another frequency converter (FU) for variation of the working speed of the ancillary unit in relation to the working speed of the main operating unit.

18. The self-propelled working machine according to claim 1, further including at least one ancillary unit and a shared generator (G), wherein the at least one ancillary unit (16) comprises at least a cooling unit, which is operable with various operating frequencies and/or operating voltages and/or which is associated to another frequency converter (FU).

19. A process for operating of a self-propelled working machine, especially in the form of a surface milling machine, such as Surface Miner, asphalt-milling machine or snow-milling machine according to claim 1, wherein at least one electrical motor (M) provided for driving of a main operating units (2) is fed during start-up by another frequency converter (FU) from an electrical power supply and after start-up and/or after reaching of a predetermined steady-state operating status the another frequency converter (FU) will be bridged and the electrical motor (M) will directly be fed from the electrical power supply.

* * * * *